US005211791A

United States Patent [19]

Best et al.

[11] Patent Number: 5,211,791

[45] Date of Patent: May 18, 1993

[54] METHOD FOR MAKING A PHOTOGRAPH SUPPORT ASSEMBLY

[75] Inventors: Scott D. Best, Troy; James F. Turner, Farmington Hills, both of Mich.

[73] Assignee: Saxon, Incorporated, Ferndale, Mich.

[21] Appl. No.: 791,026

[22] Filed: Nov. 12, 1991

Related U.S. Application Data

[62] Division of Ser. No. 622,730, Dec. 5, 1990, Pat. No. 5,092,555.

[51] Int. Cl.[5] ..... A47G 1/16

[52] U.S. Cl. ..... 156/227; 156/289; 40/152.1; 248/472

[58] Field of Search ..... 156/227, 196, 289; 248/683, 472, 469, 688, 450, 441.1, 453, 459, 460, 463, 467, 472, 473, 174, 464, 465; 40/152.1, 538, 155; 211/72; 206/455; 428/13, 46, 913.3

[56] References Cited

U.S. PATENT DOCUMENTS

| | | | |
|---|---|---|---|
| 588,636 | 8/1897 | Engstrom | 248/465 |
| 688,038 | 12/1901 | Templar | 248/459 |
| 769,535 | 9/1904 | DeLaney | 248/450 |
| 999,363 | 8/1911 | DeLacy | 248/459 |
| 1,718,406 | 6/1929 | Bruce | 248/450 |
| 2,061,294 | 11/1936 | Stephenson | 40/152.1 |
| 5,056,250 | 10/1991 | Weissleder et al. | 248/465 X |

FOREIGN PATENT DOCUMENTS

| | | | |
|---|---|---|---|
| 612442 | 4/1935 | Fed. Rep. of Germany | 40/152.1 |
| 113330 | 2/1918 | United Kingdom | 248/459 |

*Primary Examiner*—Michael W. Ball
*Assistant Examiner*—Michele K. Yoder
*Attorney, Agent, or Firm*—Reising, Ethington, Barnard, Perry & Milton

[57] ABSTRACT

A stand for displaying photographs includes a photograph (12) bonded to laminate sheets (22, 24) on both the pictorial face (16) and rear surface (18) and a support strip (14) fabricated from cellulose fiber material. The opposite end portions (36, 38) of the strip (14) are adhesively attached to the laminated rear surface (18) adjacent to the photograph (12) lower edge (20). A moment arm (50) is located between the end portions (36, 38). The moment arm (50) extends outwardly from the photograph (12), to an intermediate fold line (48) located midway between the end portions (36, 38) to form an inverted "V" shape which extends from the end portions (36, 38) to an apex point (58) at the intermediate fold line (48). In the upright position, the lower edge (20) of the photograph (12) and the apex point (58) rest upon a support surface (62) in a rearwardly inclined display position. There is a storage fold line (58) midway between the intermediate fold line (48) and either end portion (36, 38) for folding the "V" shape flat against the rear surface (18) of the photograph (12).

7 Claims, 3 Drawing Sheets

METHOD FOR MAKING A PHOTOGRAPH SUPPORT ASSEMBLY

RELATED APPLICATION

This application is a divisional of U.S. Ser. No. 622,730 filed Dec. 5, 1990, now U.S. Pat. No. 5,092,555.

BACKGROUND OF THE INVENTION

1. Technical Field

This invention relates generally to stands for displaying photographs, and more particularly to a support brace extending from the rear surface of the photograph.

2. Background art

In general, display stands are of two types; a frame which encloses the photograph or an easel on which the photograph rests. These stands have the disadvantage that they cost more than the photograph they display since both types have sections that are visible to the viewer and so the materials must be of a quality and design pleasing to the viewer. The costs of such materials needed to fabricate the stands is therefore significantly higher compared to the cost of a developed photograph. With both the frame and easel style there is the additional disadvantage that, in general, they are too bulky to be effectively packaged in the envelope containing the developed photographs.

There are two inexpensive stands available, but they are not suitable for this application. The first is a frame constructed of heavyweight paper that is commonly included in packages of photographs from professional photographers. The cost and bulk of these frames do not make it practical for film processors to include them with developed prints for the general public. Additionally, pictures placed in these frames tend to slip out. The second type consists of a sheet of cardboard with a hinged brace on the back to prop the sheet up for display. While somewhat less expensive and less bulky than the frame first described it has the disadvantage that the consumer must apply an adhesive to the cardboard sheet to mount the photograph on it. The material costs are still significant when compared to the cost of a roll of processed film.

Thus there is a need for an inexpensive, compact stand for displaying photographs that can be included by a film processor with the developed film and prints.

SUMMARY OF THE INVENTION AND ADVANTAGES

The present invention is a photograph support assembly comprising a photograph which has a pictorial face and a rear surface, a first transparent laminate sheet covering the face of the photograph, a second laminate sheet covering the rear surface and at least one of the sheets being stiff enough to hold the photograph erect. The photograph support assembly is characterized by a support strip having ends secured to the second sheet with arm means interconnecting the ends thereof and extending outwardly from the second sheet for defining a moment arm to support the assembly in a rearwardly inclined display position.

The present invention provides a support for the display of photographs which is inexpensive to produce and compact enough to include in envelopes of developed prints. The invention holds the picture in an upright position for display. It is very inexpensive to mass produce and because it is not a frame enclosing the photograph the amount of material necessary for fabrication is minimal. Additionally, since the strip is not visible as part of the display, the cost of design features is not needed. Further, the photograph cannot be dislodged from the strip as can happen in the easel-type of stand, nor can it slip out of the frame as seen in the prior art. This present invention is also smaller than the previously described brace-style and significantly less expensive to produce. Finally, the compact size of the strip makes it ideal for inclusion within an envelope.

Accordingly, the advantages of the present invention are to provide an inexpensive, compact support to display photographs.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Referring to the FIGS., wherein like numerals indicate like or corresponding parts throughout the several views, a photograph support assembly constructed in accordance with the instant invention is generally shown at 10. The photograph support assembly 10 comprises a photograph generally indicated at 12 and a support strip generally indicated at 14.

Figure 1:
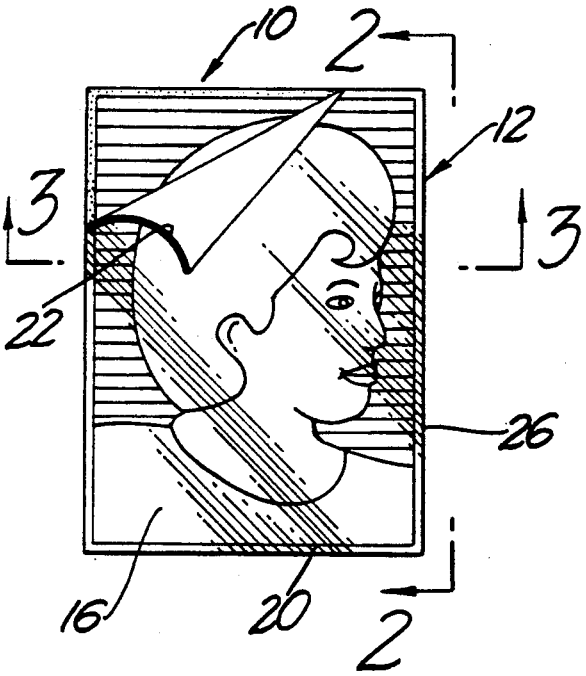
FIG. 1 is a front view of a photograph support assembly according to the instant invention.
Figure 2:
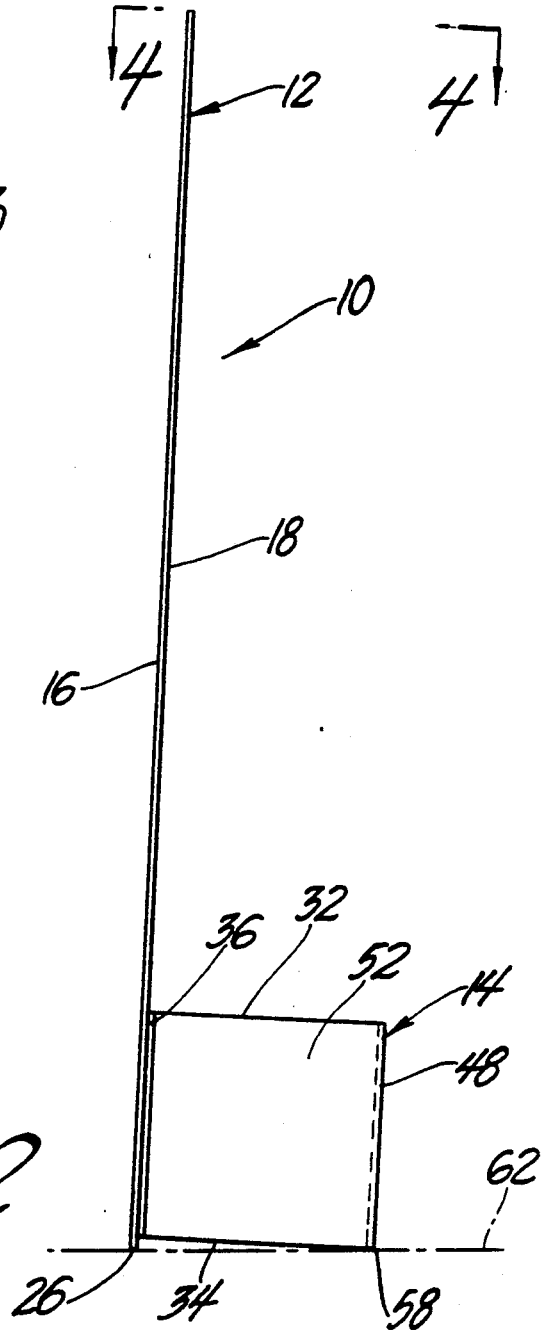
FIG. 2 is a side elevational view taken substantially along line 2—2 of FIG. 1.
Figure 3:
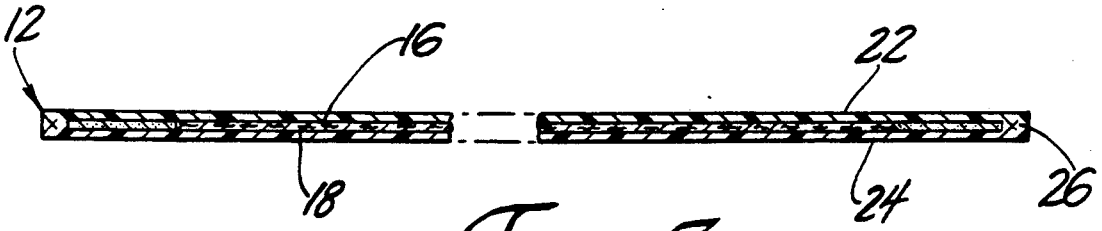
FIG. 3 is a cross-sectional view taken substantially along line 3—3 of FIG. 1.

The photograph 12 includes a pictorial face 16, a rear surface 18 and a lower edge 20 as best shown in FIGS. 1–3. The photograph 12 is an image produced on a photosensitive surface by the action of light. A first transparent laminate sheet 22 (ICI 505 2 mil superclear polyester with permanent acrylic adhesive on 92 pound lay flat liner) covers the pictorial fact 16 as best shown in FIG. 1. A second laminate sheet 24 (ICI 505 2 mil superclear polyester with permanent acrylic adhesive on 92 pound lay flat liner) covers the rear surface 18 as best shown in FIG. 3. The first transparent laminate sheet 22 has a surface with a bonding means disposed over the pictorial face 16 such that the first transparent sheet 22 is adhesively bonded to the pictorial face 16. The second laminate sheet 24 has a surface with a bonding means disposed over the rear surface 18 such that the second laminate sheet 24 is adhesively bonded to the rear surface 18. In this embodiment the laminate sheets 22, 24 extend beyond the photograph 12 to form a border 26. The border is generally in the range of one-eight to one-fourth of an inch. In an alternative embodiment the second laminate sheet 24 could have a color such that the border 26 presents a colored appearance.

The support strip 14 is fabricated from a cellulose fiber material and has a front surface 28 with a back surface 30 opposite the front surface 28. The support strip 14 has a top edge 32 and a bottom edge 34 generally parallel to the top edge 32. In the preferred embodiment the strip is fabricated from eight point coated-one-side paper stock. The opposite ends, or more specifically end portions 36, 38 are defined by a pair of end fold lines 40, 42 respectively, extending perpendicular to and connecting the top edge 32 and the bottom edge 34. Each end portion 36, 38 is of equal length and is generally less than one-eighth of the area of the support strip 14. Stress concentrators are along the end fold lines 40, 42. The stress concentrators, or more specifically score marks 44, are pressed into the front surface 28. The score marks 44 are interrupted with undistrubed portions of the end fold line 40, 42 to define a strap section of the support strip 14. There are generally three score marks 44 alternating with two undisturbed portions, or more particularly voids 46, on each and fold line 40, 42. An intermediate fold line 48 is between the end fold lines 40, 42 extending perpendicular to and connecting the top edge 32 and the bottom edge 34. Along the intermediate fold line 48 the score marks 44 alternating with voids 46 are pressed into the front surface 28.

The end fold lines 40, 42 separate each end portion 36, 38 from a central moment arm means, generally indicated at 50, to support the photograph support assembly 10 in a rearwardly inclined display position. The arm means 50 has at least one intermediate fold line 48. The intermediate fold line 48 defines within the arm means 50 a pair of arms 52, 54. The intermediate fold line 48 disposed at the midpoint between the end portions 36, 38 defines an inverted "V" shape with arms 52,54 of equal length extending from the end fold lines 40, 42 to the intermediate fold lien 48 with an apex point 58 defined by the intermediate fold line 48 perpendicularly intersecting the bottom edge 34.

Where the end fold lines 40, 42 and the intermediate fold line 48 intersect with the top edge 32 a pair of opposed corners 56 are formed. A pair of opposed corners 56 are formed at the intersection with the bottom edge 34 also. The corners are rounded extending into each of the end fold lines 40, 42 and the intermediate fold line 48.

An adhesive means is on the end portions 36, 38 extending to the end fold lines 40, 42. The back surface 30 of the end portions 36, 38 defined by the end fold lines 40, 42 are covered by the adhesive. The adhesive area is covered with a removable paper backing (not shown). In the preferred embodiment a special release pattern adhesive with a permanent 401 adhesive on a 40 pound liner is used.

Figure 5:
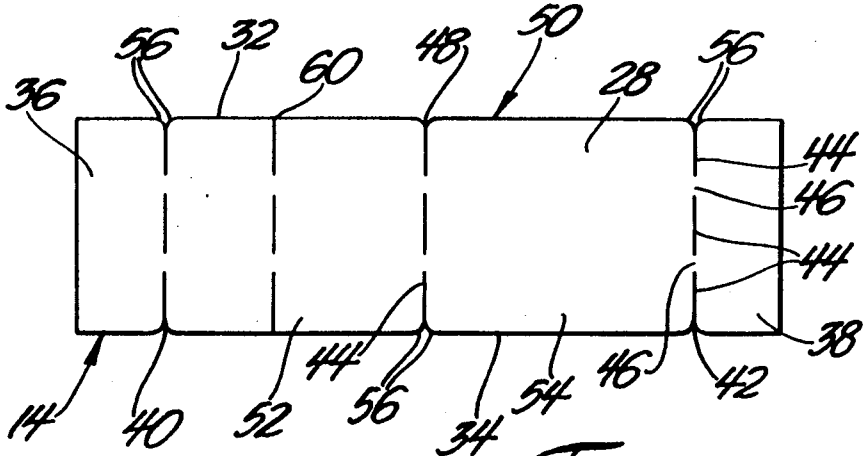
FIG. 5 is a front view of a support strip according to the instant invention.

A storage fold line 60 is disposed one half the distance between the intermediate fold line 48 and one of the end fold lines 40, 42 as shown in FIGS. 5. Along the storage fold line 60 score marks 44 alternating with voids 46 are pressed into the front surface 28.

In the method to fabricate, the strip is formed with rounded corners 56 at the intersection of each fold line and strip edge 32, 34 and extending into the ends 40, 42 and intermediate 48 fold lines. The end portions 36, 38 are covered with an adhesive, and a removable backing is placed over the adhesive end portions 36, 38. The end fold lines 40, 42 are formed at the innermost edge of each end portion 36, 38, respectively. At least one intermediate fold line 48 is formed between the end fold lines 40, 42. The storage fold line 58 is formed between the intermediate 48 and one of the end 40, 42 fold lines. Further, stress concentrators consisting of score marks 44 are formed along the strip at the fold lines. The score marks 44 are formed with voids 46 to define a strap section of the support strip 14 along the fold lines.

The photograph 12 is fabricated by covering at least part of the photograph pictorial face 16 with a first transparent laminate sheet 22 and the rear surface 18 with a second laminate sheet 24. Further, the first 22 and second 24 laminate sheets are extended beyond the edge of the photograph defining a border 26 of the laminate sheets 22, 24 adhesively bonded together.

Figure 4:
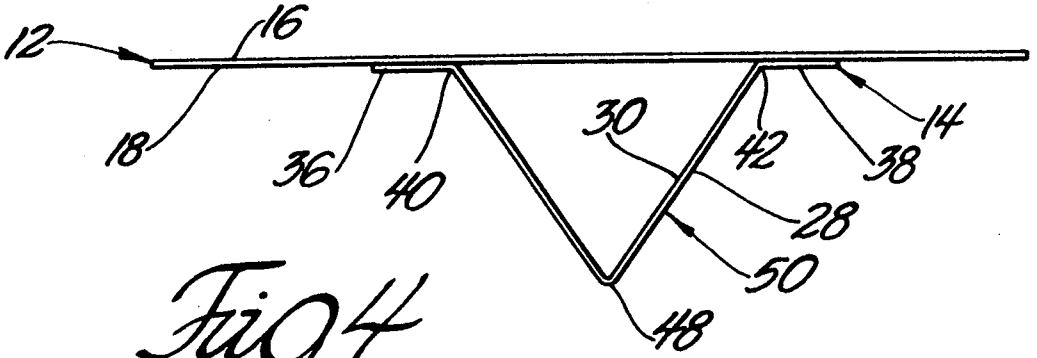
FIG. 4 is a top view taken substantially along line 4—4 of FIG. 2.

In the method of assembly the rear surface 18 of the laminated photograph 12 is exposed. The support strip 14 is removed from the backing covering the adhesive end portions 36, 38. The support strip 14 is folded at the end fold lines 40, 42 adjacent to each end portion 36, 38 and defining the end portions 36, 38. The end portions 36, 38 are folded forward along the end fold lines 40, 42 toward the front surface of the arms 52, 54 respectively. The support strip 14 is folded at an intermediate fold line 48 to form a "V"open-shaped arm as shown in FIG. 4. The arms 52, 54 are folded rearwardly toward each other to form the open "V"shape. The support strip 14 in the open "V" shape is positioned adjacent to the lower edge 20 of the photograph 12 rear surface 18 with only the end portions 36, 38 adjacent to the rear surface 18. The end portions 36, 38 are secured to the photograph 12 on the rear surface adjacent to the lower edge 20 of the rear surface 18 by pressing the adhesive end portion 36, 38 to the second laminate sheet 24. The open "V"-shaped arm 50 extends outwardly from the rear surface 18 for resting on a support surface 62 to support the photograph support assembly 10 in a rearwardly inclined display position. The apex point 58 is therefore extending outwardly from the rear surface 18 as shown in FIG. 2. The border 26 of the laminated photograph 12 and the apex point 58 of the support strip 14 rests on the support surface 62 in the upright position.

Figure 7:
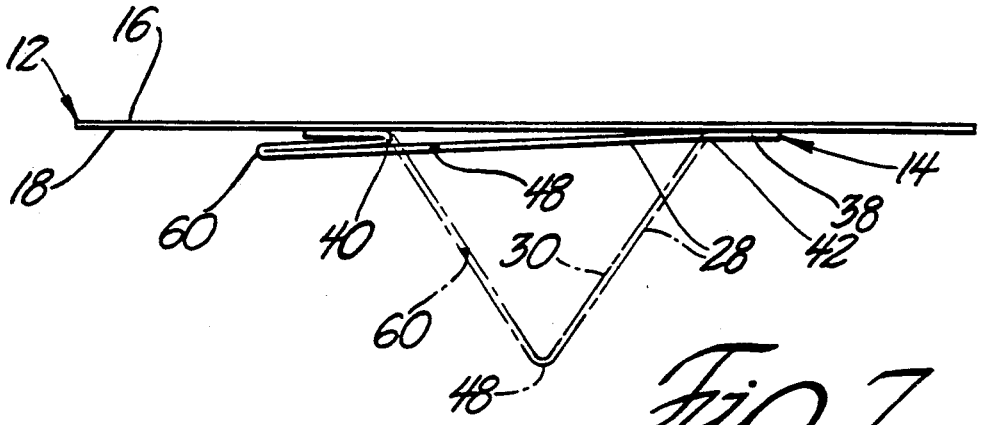
FIG. 7 is a top view of the assembly in a storage position.

The support strip 14 can be folded at the storage fold line 60 such that the support strip 14 in the open "V" shape then lays flat against the rear surface 18 as best shown in FIG. 2. In this flat storage configuration one of the arms 52,54 is folded back on itself at the storage line 60 such that the back surface 30 of the folded arm 52,54 is in a folded contiguous relationship and the storage fold line 60 is adjacent to the rear surface 18. This allows for storage or to ship the photograph support assembly 10 in an envelope. By pressing inwardly and against the storage fold line 60 in the flattened position, the open "V" shape of the storage strip 14 can be resumed and the photograph 12 again displayed as shown in FIG. 7 in phantom.

In alternate embodiments (not shown), documents, graphic illustrations, drawings or the like can be substituted for the photograph 12. Further, it would be obvious to one skilled in the art that any sheet stiff enough to stand erect can also be supported with the support strip 14.

Figure 6:
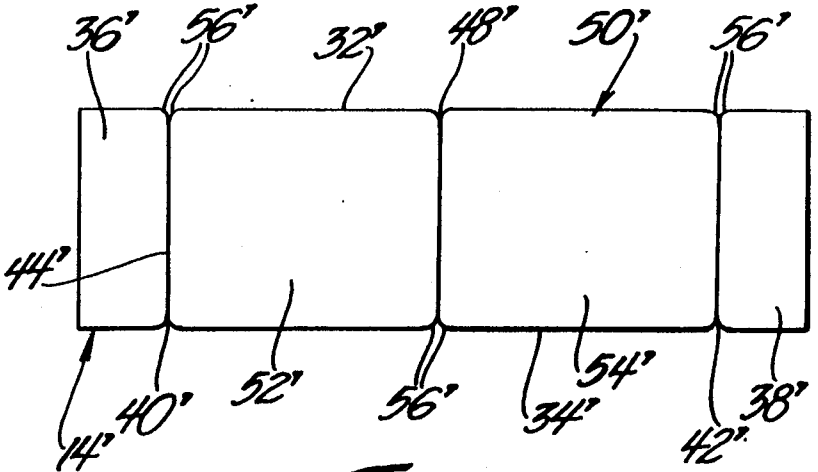
FIG. 6 is a front view of an alternate embodiment of the support strip of FIG. 5.

In an alternate embodiment shown in FIG. 6, the score mark 44 extends along the entire end fold lined 40', 42' and intermediate fold line 48'. In a second alternate embodiment (not shown) the front surface 28, only, of the strip can be covered with a laminated sheet which does not extend beyond the strip.

Figure 8:
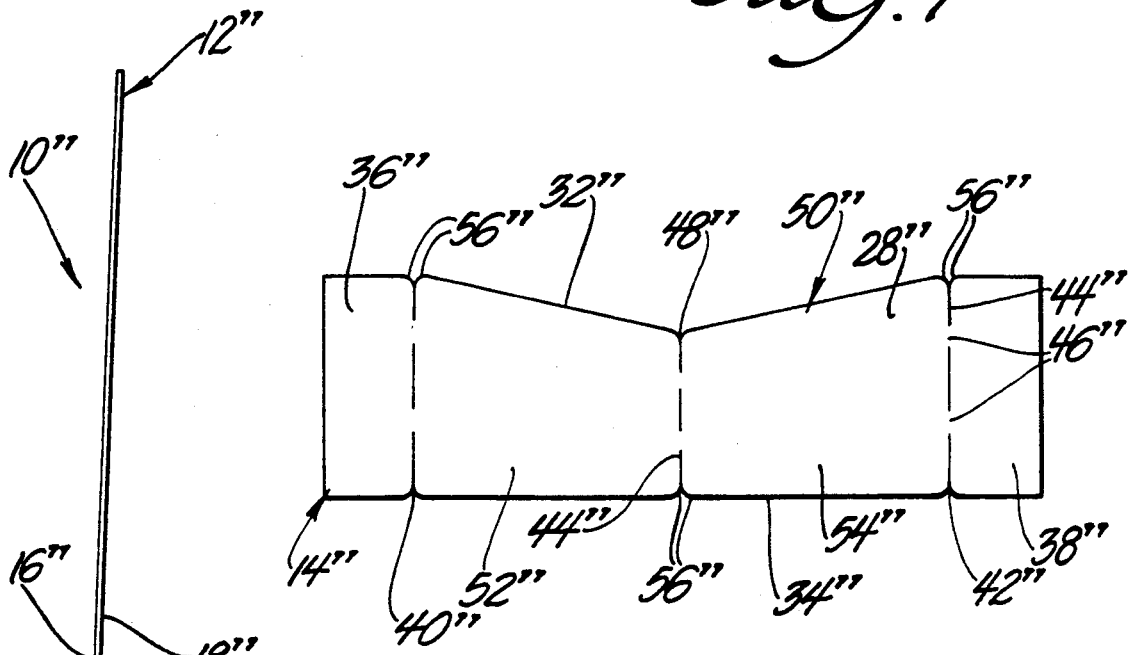
FIG. 8 is a front view of an alternate embodiment of the support strip of FIG. 5.
Figure 9:
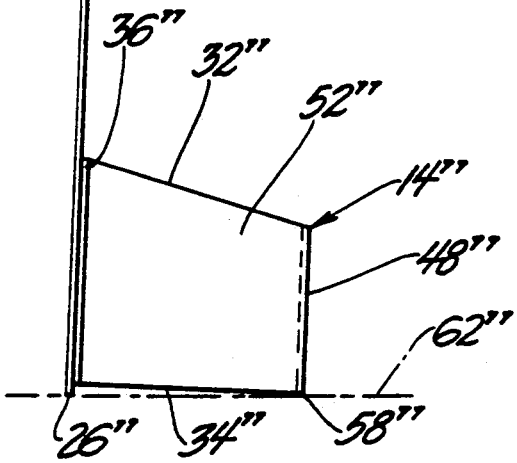
FIG. 9 is a side elevational view of an alternate embodiment of the photograph support assembly shown in FIG. 2 including the support strip of FIG. 8.

For the larger size photographs 12'', a larger size support strip 14'' is available as shown in FIGS. 8 and 9. In this embodiment, the top edge 32'' is inclined downwardly from each end fold line 40'', 42'' toward the intermediate fold line 48''.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed:

1. A method of fabricating a photograph support assembly (10) comprising the steps of:

forming a rectangular support strip (14) with opposite end portions (36,38), covering the end portions (36,38) with an adhesive, placing a removable backing covering the adhesive, folding the support strip (14) at an intermediate fold line (48), forming a pair of arms (52,54) of equal length thereby forming an open V-shaped moment arm (50) with an apex point (58), folding the support strip (14) at an end fold line (40,42) adjacent each end portion (36,38) and maintaining the open V-shape, removing the backing, positioning the support strip (14) adjacent to a lower edge of a photograph (12) rear surface (18) with only the end portions (36,38) adjacent the rear surface (18), and securing the end portions (36,38) to the photograph (12) on the rear surface (18) with the open V-shaped moment arm (50) extending outwardly from the rear surface (18) for resting the apex point (58) on a support surface (62) to support the photograph assembly (10) in a rearwardly inclined display position.

2. A method as set forth in claim 1 further characterized by forming rounded corners (56) at the intersection of each fold line and strip edge (32,34) and extending into the end (40,42) and intermediate (48) fold lines.

3. A method as set forth in claim 1 further characterized by forming a storage fold line (60) and folding the support strip (14) at the storage fold line (60) disposed between the intermediate fold line (48) and one of the ends to flatten the support strip (14) against the rear (18) of the photograph (12).

4. A method as set forth in claim 1 further characterized by forming a plurality of stress concentrators (44) along the support strip (14) at the fold lines (40,42,48,60).

5. A method as set forth in claim 4 further characterized by forming the stress concentrators (44) with undisturbed portions (46) of the support strip (14) to define a strap sections (46) of the support strip (14) along the fold lines (40,42,48,60).

6. A method as set forth in claim 5 further characterized by covering at least part of a photograph front surface (16) with a first transparent laminate sheet (22) and the photograph rear surface (18) with a second laminate sheet (24) and securing the end portions (36,38) of the support strip (14) to the second laminate sheet.

7. A method as set forth in claim 6 further characterized by extending the first (22) and second (24) laminate sheets beyond the photograph (12) to define a border (26) of the sheets (22,24) bonded together.

* * * * *